United States Patent [19]

Olsen

[11] 4,103,468

[45] Aug. 1, 1978

[54] DRAINABLE BLADE LOUVER

[75] Inventor: Robert W. Olsen, New Providence, N.J.

[73] Assignee: Construction Specialties, Inc., Cranford, N.J.

[21] Appl. No.: 790,025

[22] Filed: Apr. 22, 1977

[51] Int. Cl.[2] ..... F24F 13/08

[52] U.S. Cl. ..... 52/473; 98/121 R

[58] Field of Search ..... 52/77, 78, 473; 98/88, 98/121 R

[56] References Cited

U.S. PATENT DOCUMENTS

| | | | |
|---|---|---|---|
| 3,287,870 | 11/1966 | Johnson | 52/473 |
| 3,782,050 | 1/1974 | Dowdell et al. | 52/473 |

FOREIGN PATENT DOCUMENTS

| | | | |
|---|---|---|---|
| 341,556 | 1/1931 | United Kingdom | 98/121 R |

*Primary Examiner*—James L. Ridgill, Jr.

*Attorney, Agent, or Firm*—Brumbaugh, Graves, Donohue & Raymond

[57] ABSTRACT

A drainable blade louver comprises a pair of spaced-apart vertical members supporting a multiplicity of elongated, horizontally extending, inclined blades, each of which is of uniform cross section along its length. Each blade has an upwardly open front drainage trough located adjacent the front edge of the blade and at least one second upwardly open drainage trough located in at least about the front one-third of the blade closely adjacent the front trough. Each of the troughs is defined by spaced-apart front and back walls, the upper edges of which are preferably located in a plane substantially parallel to the airflow streams passing between the blades, and a bottom wall spaced a substantial distance below the upper edges of the front and back walls such that the splash from water drops impinging on the bottom walls of the troughs is largely confined to the zone bounded by the walls of the troughs thereby minimizing entrainment of water in the airflow streams.

5 Claims, 1 Drawing Figure

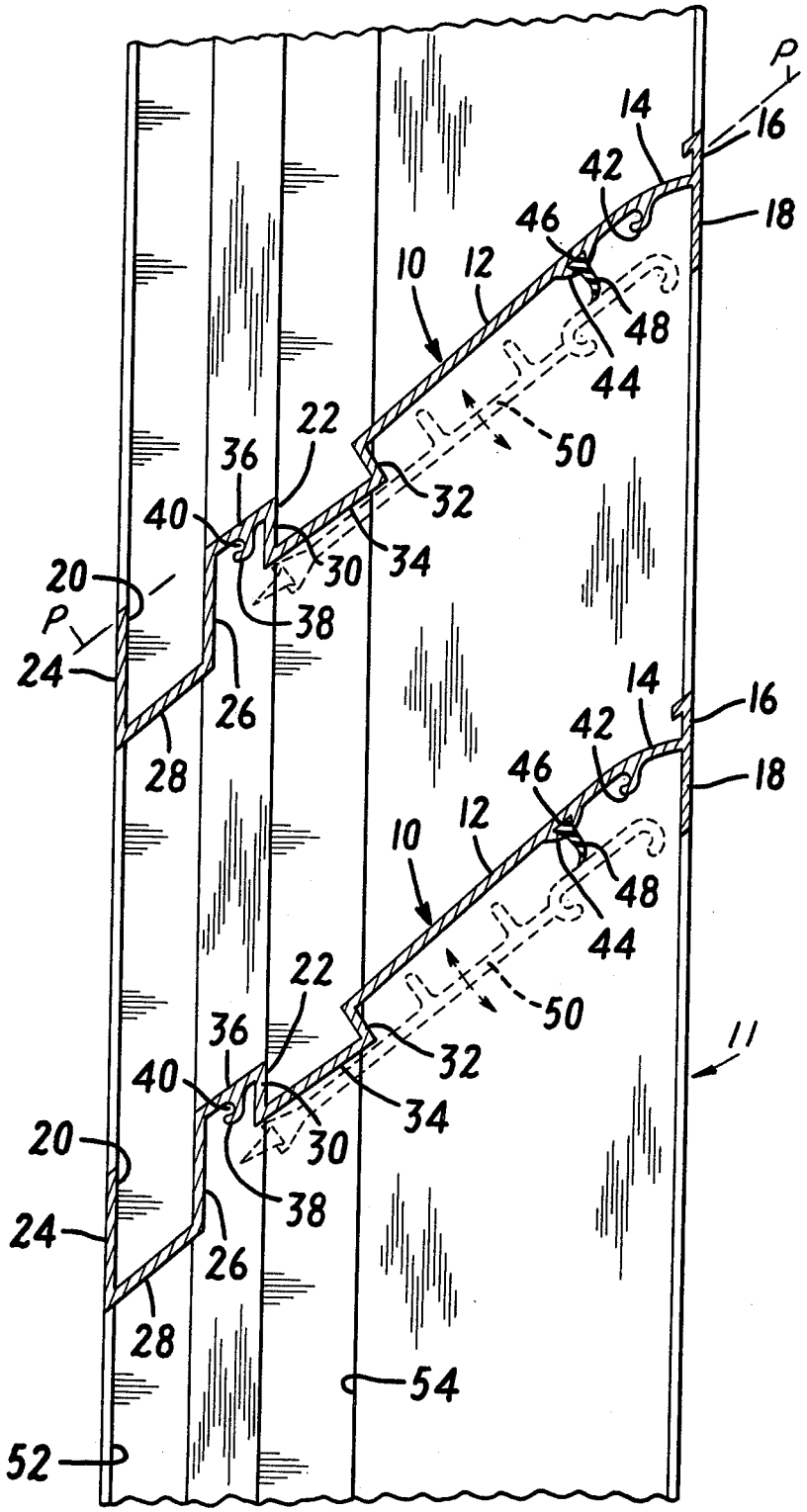
P
14
16
42
18
46
10
12
48
44
22
50
36
32
40
34
30
20
38
P
24
26
28
14
16
42
46
18
10
12
48
44
22
50
36
32
11
40
34
30
20
38
24
26
28
54
52

DRAINABLE BLADE LOUVER

BACKGROUND OF THE INVENTION

It is often desirable and sometimes important to minimize the intrusion of water through a louver. In such instances, so-called drainable blade louvers should be used. The principal characteristic of drainable blade louvers is the provision at the front, lower edge of each blade of an upwardly extending flange or a trough which catches water that impinges on the blade and prevents it from flowing off the lower front edge of the blade down the front of the louver. The trough opens at one or both ends of the blade into a vertical drainage channel in the vertical mullions or side frames of the louver. Such troughs in the blades of drainable blade louvers have been somewhat successful in limiting water penetration through the louver in that water that flows or drips down from blade to blade in conventional louvers and that is susceptible of becoming entrained in the airflow is eliminated.

Another provision in the design of at least one known form of blade for a drainable blade louver is a vertical offset or step at approximately the mid point of the blade profile which is intended to present a vertical surface or dam for catching water drops entrained in the airflow. Again, such a step provides some reduction in water penetration through the louver.

It must, of course, be recognized that no open louver can be constructed in such a way as to entirely prevent intrusion of water under severe weather conditions. On the other hand, any significant reduction in water entrainment can be of practical importance.

SUMMARY OF THE INVENTION

There is provided, in accordance with the present invention, a drainable blade louver that, on the basis of standard industry tests, has shown a remarkable reduction in so-called "water penetration," a term used to refer to intrusion of water in any form through the louver. The blade, according to the invention, is of uniform cross section along its length and includes an upwardly open front drainage trough adjacent the front edge and at least one second upwardly open drainage trough located in at least about the front or lower one-third of the blade adjacent the front trough. Each of the troughs is defined by spaced-apart front and back walls, the upper edges of which are located, preferably, in a plane parallel to the airflow streams through the passages between the blades, and a bottom wall spaced a substantial distance below the upper edges of the front and back walls such that the splash from water drops that impinge on the bottom walls is largely confined to the zone bounded by the walls of the troughs.

The invention takes advantage of the tendency for the splash pattern of a water drop impinging on a surface to be in the form of a spray of fine droplets that "mushroom" out from the zone of impingement at a fairly small angle oblique to the plane of the surface on which the drop impinges. Thus, the troughs in a blade, according to the invention, are relatively deep so that the spray droplets from splashes do not rise above the tops of the walls. The zones within the troughs are out of the airflow passing through the louver, and the splash that occurs in the troughs, because it is confined largely to such zones within the troughs, does not become entrained in the airflow.

The bottom walls of the troughs may be flat or slightly curved and are preferably oriented substantially parallel to the airflow streams, an orientation which makes them generally perpendicular to the trajectory of drops that impinge upon them. This, in turn, orients the splash generally parallel to the airflow streams through the louver. It is desirable for the width at the bottom of each trough to be not less than the width of the top opening of the trough so that full advantage is taken of the profile in terms of impingement of drops entering through the opening of the troughs on the bottom walls.

It is difficult, at best, to define clear cut parameters in respect of the location and size of the troughs, and the degree to which any particular design will minimize water penetration will, of course, depend somewhat on the specific design. At either extreme of the virtually unlimited design parameters are the provision of a multiplicity of very deep troughs occupying virtually the entire width of the blade, on the one hand, and relatively small shallow troughs located in only a relatively small transverse portion of the blade adjacent the lower or front end, on the other hand.

In the former case, the advantage of many relatively deep troughs is one of reduced return in terms of preventing water penetration in that the troughs located in, say, the upper one-half of the blade will function only under relatively severe wind and rain conditions, but certainly such an arrangement will provide benefits that may justify the design, notwithstanding the disadvantages of a reduction in open area and the increased turbulence in the flow (and thus higher resistance to flow) in a blade having troughs over most of its width.

At the other end of the scale, small troughs occupying but a small fraction at the front end of the blade will provide minimal benefits in terms of reduced water penetration in that (1) water drops are likely to impinge higher up on the blade in more or less normal bad weather conditions, and (2) splash within the troughs will to a greater extent enter the airflow stream with an increased likelihood of entrainment in the airflow.

As described in more detail below, the embodiment shown in the drawing has exhibited a very marked improvement in water penetration in tests of the Air Moving & Conditioning Association, Inc. (AMCA Standard 500–75, "Water Penetration," test set-up apparatus: per figure 5.6). At a water drop rate of 4.0 inches per hour and a wetted wall water flow rate of 0.25 gpm per foot, such tests on the embodiment shown in the drawing produced results ranging from a water carry-over of 0.002 ozs./sq.ft. of free area at an air flow of approximately 800 cfm/sq.ft. of area to 0.007 ozs./sq.ft. of free area at approximately 1250 cfm/sq.ft. of free area. Such results are believed to be approximately 10 times better than those obtained with any presently known drainable blade louver and several tens of times better than those obtained with many presently known drainable blade louvers.

DESCRIPTION OF THE DRAWING

The single FIGURE of the drawing is a vertical, transverse cross section of a typical portion of a louver embodying the present invention.

DESCRIPTION OF EXEMPLARY EMBODIMENT

The louver shown in the drawing consists of a multiplicity of vertically spaced, elongated, horizontal, inclined blades 10, all of which are identical (except in some instances for the bottom and top blades, which might be different). Each of the blades 10 is of uniform cross section along its length and is preferably made by cutting a suitable length piece from an aluminum extrusion. The blades of louvers constructed in accordance with the invention can, of course, also be made in other ways, such as by bending sheet metal (e.g., by roll-forming) or from other materials (e.g., plastic or steel). The blades are mounted within a peripheral frame that is designed and constructed to fit into an opening in a building wall or to be otherwise suitably installed in any desired structure, the blades being fastened to vertical members of the frame or to mullions spaced at appropriate distances between the side members of the frame. A typical vertical end frame member 11 is shown in the drawing; a second vertical frame member identical to the member 11 is fastened to the other ends of the blades 10.

Each blade 10 shown in the drawings comprises a generally planar back or upper wall portion 12 that constitutes, in the illustrated embodiment, generally the upper one-half of the transverse extent of the blade. It is desirable, as shown, to provide a downwardly curving portion 14 and an upwardly extending lip 16 at the upper edge of the blade, thus to provide a small dam (the lip 16) at the upper end to stop any layer of water that may tend to be blown along the surface of the blade from leaving the back edge of the blade. A downwardly extending flange 18 at the upper edge of the blade is provided for structural reasons.

There are two troughs, 20 and 22, located in generally the lower or front one-half of the transverse extent of the blade. The lower or front trough 20 is bounded by a vertical front wall 24, a vertical back wall 26 and a bottom wall 28. The upper edges of the front and back walls 24 and 26 are located substantially in the plane of the flat back part 12 of the blade, which, in turn, is generally parallel to the airflow streams in the passages between blades, and the bottom wall 28 is located a substantial distance below that plane and is oriented substantially parallel to that plane. From close observation of the drawing, one will observe that there is actually a slight overall curvature to the blade from front to back, but that curvature is of no significance to the present invention; it is a design feature that provides a slightly greater free area than would be provided by a straight or flat profile.

The second or back trough 22 has a vertical front wall 30, a back wall 32 that is perpendicular to the flat back portion 12 and a bottom wall 34 that is spaced a substantial distance below (e.g., about one-half inch) and lies substantially parallel to the plane of the back portion 12 of the blade. A short, inclined, flat wall portion 36 located substantially in the plane of the back wall portion 12 (as indicated by the dashed line designated "P" in the drawing) connects the upper end of the back wall 26 of the front trough 20 to the front wall 30 of the back trough 22 and is present only to accommodate a generally "J"-shaped rib 38 on the under side thereof which defines a generally circular cavity 40 for reception of a self-tapping screw at each end of the blade by which the blade is fastened to the vertical frame members or mullions of the louver. A similar "J"-shaped rib 42 is provided for the same purpose near the upper edge of the blade.

A pair of ribs 44 on the under side of the back part 12 of the blade define a dovetail slot 46 that receives a seal 48 in the event that an optional set of operating louver blades 50 (which are shown in dotted lines in the drawing to indicate that they are optional) is provided in a particular installation. The optional operating blades are pivoted at each end and are movable by a suitable operating mechanism to be closed or retracted into open position, as shown, in which case they are received within a space defined by the wall 26 and the rear flange 18 of the blade. The desire to have the operating blades recessed within the under side of the blade profile in one reason for the difference in depth between the front trough 20 and the back trough 22. Furthermore, the front trough is also larger so that it will have more water capacity.

Each of the troughs of the blades of louvers, according to the present invention, should be relatively narrow, say on the order of one inch in width, and deep, say not less than one-half inch. The top opening of a wide trough will permit the airflow to dip relatively deeply into the trough and sweep out some of the spray of droplets coming from drops that splash on the bottom of the trough, and a shallow trough will not shield or confine the droplet spray or splash from drops to the zone within the trough — a significant part of the spray or splash of droplets will rise above the top of the trough and become entrained in the airflow and be carried through the louver.

The particular configuration of the vertical parts of the frame and any intermediate mullions in which the blades are mounted is of no particular importance, and therefore, no cross-sectional views are included. However, each mullion and the vertical or end members of the frame has vertical drains 52 and 54 in the form of vertical channels that are in register with the bottoms of the troughs 20 and 22.

Under moderate to severe storm conditions involving winds blowing in a direction into the louver, rain impinging on the wall of the building vertically above the louver will come down the wall and drip, or perhaps flow as a curtain of water, down across the top-most opening of the louver. In some installations, a gutter will be provided at the top of the louver to catch water coming from the wall of the building above the louver. However, the louver shown in the drawing is designed to catch such water, primarily in the front trough 20 of the top-most blade. If the flow is great, the top trough may overflow and drop to the trough of the second higher blade, and so on. In the latter respect, the louver shown in the drawing functions in a way that is similar to presently known drainable blade louvers, in that the front trough collects and drains to either end of the uppermost blades the downflow of water coming down the wall of the building from above the louver.

The louver shown in the drawing, and louvers embodying the present invention, go one step further. In the case of intake louvers in which there is an airflow from front to back of fairly high velocity or under high winds having a substantial component toward the front of the louver, it is inevitable that rain drops will be pulled or be driven by the airflow into the spaces between the blades. The same is true of drops that drip off of the front faces of the walls 24 of the front troughs. The rain drops and the drip from the walls 24 that enter between the blades impinge directly upon the lower part of each of the blades, and the major part of the drops that enter between the blades will impinge on the lower part of the blades, except with very high winds. In a louver according to the present invention, the major portion of the drops impinging in the lower part of the blade impinge on the back or bottom walls 32, 34, 26 and 28 of the two troughs 20 and 22. The splash of a rain drop tends to lie relatively flat to the surface on which it impinges, and the splash from drops impinging on the walls of the trough will be largely confined to zones lying within the troughs. Based on the tests referred to above, it appears that only a very small part of the splash from drops entering the spaces between the blades becomes entrained in the airflow through the louver. Thus, much of the water entering between the blades is collected in the troughs and flows to the drainage channels 52 and 54. It is conjectured, though not established, that turbulent currents of air flowing near the openings of the troughs and along the narrow wall 36 between the troughs tend to coalesce the fine spray of droplets from rain drops that impinge on the wall portion 36 and the small fraction of the spray from drops impinging within the troughs that rises above the plane of the blade into the airflow. The larger drops coalesced from the fine spray are less likely to become entrained in the airflow and are most probably collected in the second trough 22.

I claim:

1. In a louver having a pair of spaced-apart vertical members supporting a multiplicity of elongated horizontally extending inclined blades, each of which is of uniform cross section along its length and has a front edge that is located substantially below its back edge, and an upwardly open front drainage trough located adjacent the front edge of the blade, the improvement wherein each blade has at least one second upwardly open drainage trough located in at least about the front one-third of the blade closely adjacent the front trough, each such trough being defined by spaced-apart front and back walls, the upper edges of which are located substantially above a bottom wall of the trough such that the splash from water drops impinging on the bottom walls of the troughs is largely confined to the zones bounded by the walls of the troughs, thereby minimizing entrainment of water in an airflow through the spaces between the blades from front to back, and wherein each vertical member has a vertical drainage channel in register with the corresponding troughs of all blades and receiving water therefrom.

2. An improvement in a louver according to claim 1, wherein each trough is on the order of one inch in width and greater than about one-half inch in depth.

3. An improvement in a louver according to claim 1, wherein each blade has a generally planar inclined wall portion adjacent the back edge and the upper ends of the front and back walls of the gutters are substantially in the plane of said wall portion.

4. An improvement in a louver according to claim 1, wherein the width of each second trough at the bottom thereof is greater than the width at the top thereof.

5. An improvement in a louver according to claim 1, wherein the upper ends of the front and back walls of each trough define generally a plane that is parallel to the airflow streams in the passages between the blades.

* * * * *